US007089948B2

(12) United States Patent
DeBoer et al.

(10) Patent No.: US 7,089,948 B2
(45) Date of Patent: Aug. 15, 2006

(54) IN-SINK DISHWASHER WITH INTEGRATED LATCH

(75) Inventors: John M. DeBoer, St. Joseph, MI (US); Larry D. Marks, St. Joseph, MI (US); Ryan K. Roth, St. Joseph, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 844 days.

(21) Appl. No.: 10/138,277

(22) Filed: May 3, 2002

(65) Prior Publication Data

US 2003/0205252 A1 Nov. 6, 2003

(51) Int. Cl.
*B08B 3/00* (2006.01)
*A47K 13/00* (2006.01)

(52) U.S. Cl. ..... 134/57 DL; 134/200; 4/242.1

(58) Field of Classification Search ..... 134/57 DL, 134/58 DL, 115 R, 200, 201; 4/619, 638, 4/242.1; 292/340, 341.15, 341.17, 216, 241, 292/336.3, DIG. 69

See application file for complete search history.

(56) References Cited

U.S. PATENT DOCUMENTS

| | | | | | |
|---|---|---|---|---|---|
| 2,031,427 | A | * | 2/1936 | Papworth | 210/379 |
| 2,302,012 | A | * | 11/1942 | Dyer | 68/23.3 |
| 2,575,704 | A | | 11/1951 | Clark | 134/58 |
| 2,579,393 | A | | 12/1951 | Modrey | 4/187 |
| 2,618,282 | A | | 11/1952 | Stanitz et al. | 134/58 |
| 2,692,602 | A | | 10/1954 | Stanitz et al. | 134/57 |
| 2,713,345 | A | | 7/1955 | Stanitz et al. | 134/55 |
| 2,745,417 | A | | 5/1956 | Fielding | 134/58 |
| 2,759,485 | A | | 8/1956 | Guth | 134/58 |
| 3,092,134 | A | * | 6/1963 | Allen et al. | 137/355.17 |
| 3,841,675 | A | * | 10/1974 | Mercer | 292/241 |
| 3,854,762 | A | * | 12/1974 | Spiegel et al. | 292/197 |
| 4,951,693 | A | | 8/1990 | Archambault | 134/57 |
| 5,178,172 | A | * | 1/1993 | Morley | 134/183 |
| 5,881,746 | A | | 3/1999 | Buser et al. | 134/58 |
| 5,915,851 | A | * | 6/1999 | Wattrick et al. | 4/619 |

FOREIGN PATENT DOCUMENTS

| | | |
|---|---|---|
| DE | 3922754 | 1/1991 |
| DE | 3345604 | 7/1998 |
| DE | 4420775 | 8/1998 |
| GB | 929348 | 6/1963 |
| JP | 10225330 | 8/1998 |
| JP | 10225331 | 8/1998 |

OTHER PUBLICATIONS

Patent Abstracts of Japan.
Application 08–185824, Date of Filing Jul. 16, 1996, Patent Abstracts of Japan.
Application 2000–235115, Date of Filing Feb. 18, 1997.

* cited by examiner

*Primary Examiner*—Joseph Perrin
(74) *Attorney, Agent, or Firm*—Robert O. Rice; John F. Colligan; Stephen Krefman

(57) ABSTRACT

A dish-cleaning appliance comprising a sink defining a wash chamber with an open top for providing access to the wash chamber. A liquid recirculation system is provided for spraying liquid onto the dish rack to effect the cleaning of any dishes along the rack. The lid is mounted to the sink and is movable to selectively cover the open top of the bowl. A latch is provided to hold the lid in the closed position. The latch comprises a catch and a strike, with the strike having an integrated handle resulting in a small form factor.

35 Claims, 12 Drawing Sheets

IN-SINK DISHWASHER WITH INTEGRATED LATCH

BACKGROUND OF THE INVENTION

1. Field of the Invention

The invention relates to an in-sink dishwasher for automatically washing household dishes without requiring the physical space of a built-in automatic dishwasher. The invention further relates to an in-sink dishwasher having a small form factor latch for holding a lid of the dishwasher in a closed position.

2. Description of the Related Art

In-sink dishwashers use the bowl of a sink to form part of the dishwasher housing that defines a wash chamber, with the open top of the bowl providing access to the wash chamber. A liquid recirculation system sprays wash liquid throughout the wash chamber to clean any dishes placed therein. A lid covers the open top of the bowl when the in-sink dishwasher is being used to prevent the splashing or spraying of the recirculating wash liquid out of the open top of the bowl.

It is desirable to secure the lid to the sink or surrounding cabinet during the operation of the dishwasher to prevent the opening of the lid while the liquid is recirculated in the wash chamber.

In traditional front-loading dishwashers, a latch is used to secure the door. The latch preferably includes a manual release for the user to open the door, even during a wash cycle. The manual release is preferably coupled to a stop switch that stops the wash cycle if the lid is opened during a wash cycle.

It is desirable to also use a latch for securing the door of the in-sink dishwasher. There are several design criteria unique to the in-sink dishwasher that make using a latch more difficult than the traditional front-loading dishwashers: the lid is top-mounted and the sink is mounted within a traditional cabinet structure, with very little space between the sink and the cabinet face. The top mounting of the lid prevents the depth of the cabinet from being used for receiving part of the latch structure as is common in front-opening traditional dishwashers. For aesthetic and installation simplicity, it is not desirable to have any part of the latch extend through the cabinet face. It is desirable to keep the manual operability of the latch and to place the latch at the front of the in-sink dishwasher for easy access by the user. These constraints make it highly desirable to place the latch in the area between the sink and the cabinet face where there is very little usable space. The desire to have full functionality in the latch exacerbates the space issue since prior latch designs often relied on complex mechanical linkages that required a relative large space.

SUMMARY OF THE INVENTION

The invention relates to a dish-cleaning appliance comprising a sink having a bottom wall and a peripheral sidewall that extends upwardly from the bottom wall. The bottom wall and peripheral sidewall defining a wash chamber. The peripheral sidewall defines an open top that provides access to the wash chamber. The dish-cleaning appliance further comprises a lid mounted to the sink and movable between an opened and a closed position to selectively cover the top opening of the sink. The lid has a lower surface and an upper surface, with the lower surface facing the bottom wall when the lid is closed.

A latch is provided for holding the lid in the closed position. The latch comprises a strike on which is mounted a handle and a catch. The strike is mounted to the lid for rotation between a latched and a released position. The catch is mounted to the sink and engages the strike when the lid is in the closed position and the strike is in the latched position.

The user can grasp the handle and move the lid to the closed position where the strike, in the latched position, is engaged by the catch to hold the lid in the closed position. The user can also rotate the handle to rotate the strike to the released position, thereby permitting the moment of the lid from the closed to the opened position.

The strike can comprise a strike face extending beyond the lower surface of the lid and the catch engages the strike face when the strike is in the latched position to hold the lid in the closed position. The strike face can have a notch in which the catch is received when the strike is in the latched position to effect the engagement between the strike and the catch. A cam surface is provided on the strike face and leads to the notch. The catch can comprise a laterally movable slider that follows the cam surface into and out of the notch as the strike is rotated between the latched and the released positions.

The strike face has a substantially cylindrical body with a peripheral surface. The notch extends laterally from the peripheral surface into the cylindrical body, with the body defining a rear wall of the notch. The cam is a curved surface formed into the cylindrical body and extends from a tangential intersection with the peripheral wall to an intersection with the rear wall of the notch.

The notch can have a top and bottom wall, each of which extends from the peripheral surface to the rear wall. The top and bottom walls taper from the peripheral surface toward the rear wall. The slider has a tapered end designed to interact with the tapered top and bottom walls of the notch such that the top and bottom walls of the notch guide the tapered end of the slider into the notch.

A radial rib can be provided in the notch and extends from the rear wall of the notch and forms a key. The slider has a recess formed in the tapered end that defines a key way in which the radial rib is received when the strike is in the latched position to help guide the slider into the notch and hold the slider in an engaged condition with the strike face.

A biasing device can be provided for biasing the strike face into the latched position to ensure that the strike will be properly positioned to receive the slider when the lid is closed. Alternately the biasing device can be provided for biasing the strike face into the unlatched position to require manual rotation of the strike into position to receive the slider when the lid is closed. A second biasing device can be provided for biasing the slider into engagement with the strike face to automatically engage the strike face when the lid is closed.

The strike can also comprise a shaft that extends through the lid. An upper end of the shaft extends beyond the upper surface and mounts the handle. A lower end of the shaft extends beyond the lower surface and mounts the strike face. A suitable handle is a knob eccentrically mounted to the upper into the shaft.

The catch can also comprise a guide having a hollow interior with an inlet opening located in the sink such that the strike face is received within the guide through the inlet opening when the lid is in the closed position. The catch further comprises a biasing device that lifts the lid from the closed position to at least a partially opened position when the strike face and slider are not engaged. The lid-biasing device can comprise a plunger having a head located within the guide and a spring extending between a portion of the guide and the head to bias the head toward the inlet opening where it will bear against the strike face to urge the lid to the partially opened position. The plunger should have sufficient travel such that the head closes the inlet opening when the strike face is removed from the guide.

The slider will generally have sufficient movement such that the path of the slider extends into the path of the plunger thereby permitting the plunger to contact the slider and urge it laterally out of the path of the plunger as the plunger moves to raise the lid. When the plunger is extended, the head of the plunger blocks the slider from lateral movement into the guide.

An actuator can be provided and coupled to the slider for laterally moving the slider out of engagement with the strike face thereby permitting the lid-biasing device to move the lid to the partially opened position. A suitable actuator includes a wax motor.

A power switch can be provided and coupled to the slider such that when the slider is not engaged with the strike face, the slider disengages the normally open power switch to shut off power to one or more components of the dish-cleaning appliance. The coupling of the slider to the power switch is arranged to disengage the power switch before allowing the lid to open to assure that the dish-cleaning machine stops before the lid opens.

In another aspect, the invention relates to an in-sink dishwasher comprising a sink, with a bottom wall and a peripheral sidewall extending upwardly therefrom. The bottom wall and sidewall define a wash chamber, with the peripheral sidewall defining a top opening through which access is provided to the wash chamber. The lid is mounted to the sink and movable between an opened and a closed position to selectively cover the top opening when the lid is in the closed position. The lid has a lower surface and an upper surface, with the lower surface facing the bottom wall when the lid is closed. A strike comprising a handle and a strike face is mounted to the lid. The handle is directly connected to the strike face and permits the rotation of the strike between a latched and a released position. A catch is mounted to the sink and engages the strike face when the lid is in the closed position and the strike is in the latched position. The user can grasp the handle and move the lid to the closed position where the strike is rotated into the latched position and is engaged by the catch to hold the lid in the closed position. The user can rotate the handle to rotate the strike to the released position, thereby permitting the movement of the lid from the closed to the opened position.

DESCRIPTION OF THE PREFERRED EMBODIMENT

Figure 1:
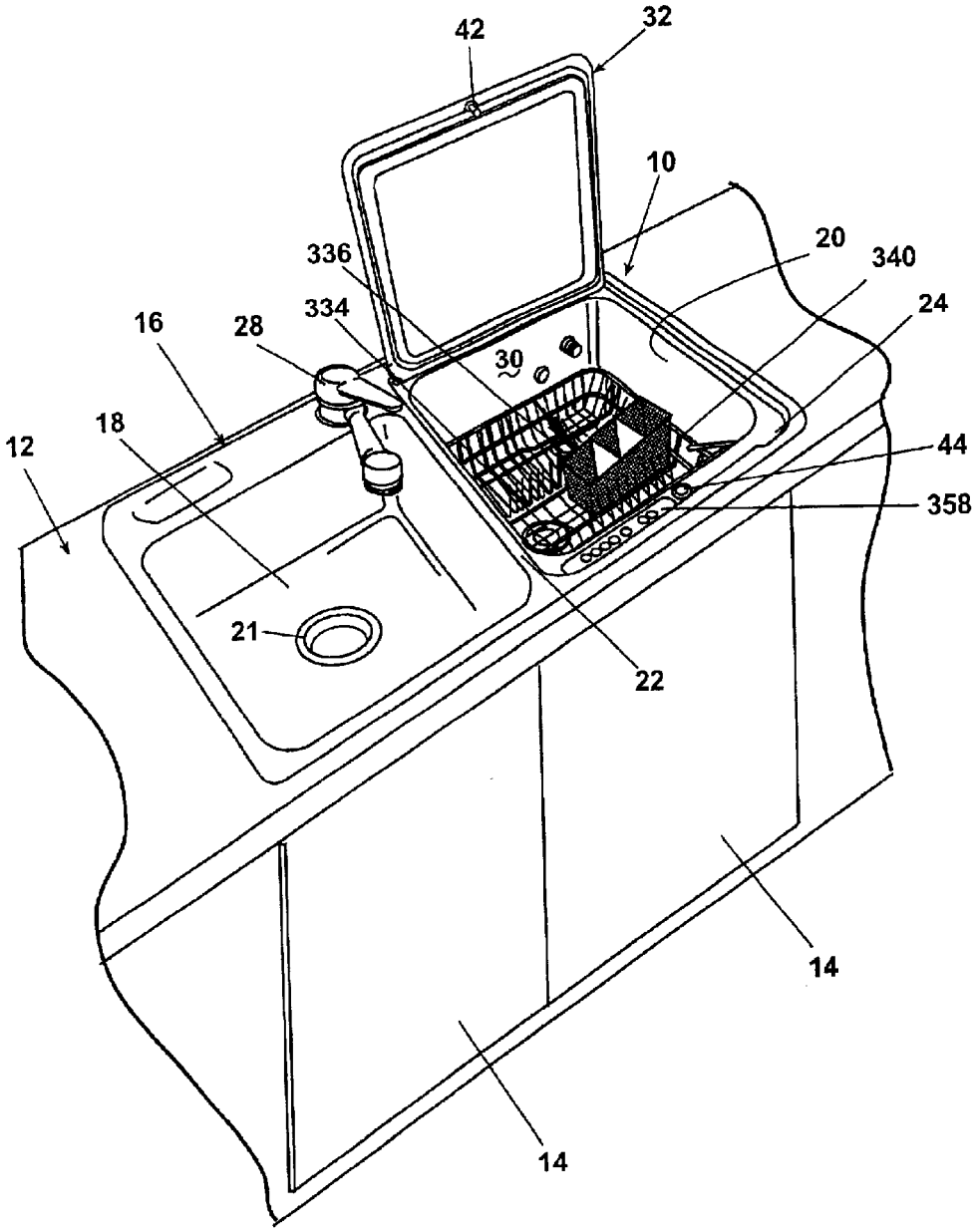
FIG. 1 is a perspective view of an in-sink dishwasher according to the invention, with the in-sink dishwasher shown mounted in a cabinet, the sink being of a double-bowl configuration and the one bowl forming part of the in-sink dishwasher having a lid, shown in an opened position, for covering the one bowl, and a latch comprising a strike carried by the lid and a catch mounted to the sink for securing the lid in a closed position.

FIG. 1 illustrates an in-sink dishwasher 10 mounted in a traditional cabinet fixture 12 having doors 14 providing access to the cabinet interior where the lower portion of the in-sink dishwasher 10 is located.

The in-sink dishwasher 10 is illustrated in the environment of a double-bowl sink 16 comprising a first bowl 18 and a second bowl 20. The first bowl 18 performs the function of a traditional sink bowl and includes a drain opening 21. The second bowl 20 performs the dual function of a traditional sink bowl while also forming a portion of the housing for the in-sink dishwasher.

The first and second bowls 18, 20 are spaced from each other to define an intervening flange portion 22 that intersects a peripheral flange 24 surrounding both of the bowls 18, 20. Preferably, the double-bowl sink is made from stainless steel.

A traditional water faucet 28 is located in the peripheral flange 24 of the double-bowl sink and provides water to either of the first and second bowls 18, 20.

Figure 2:
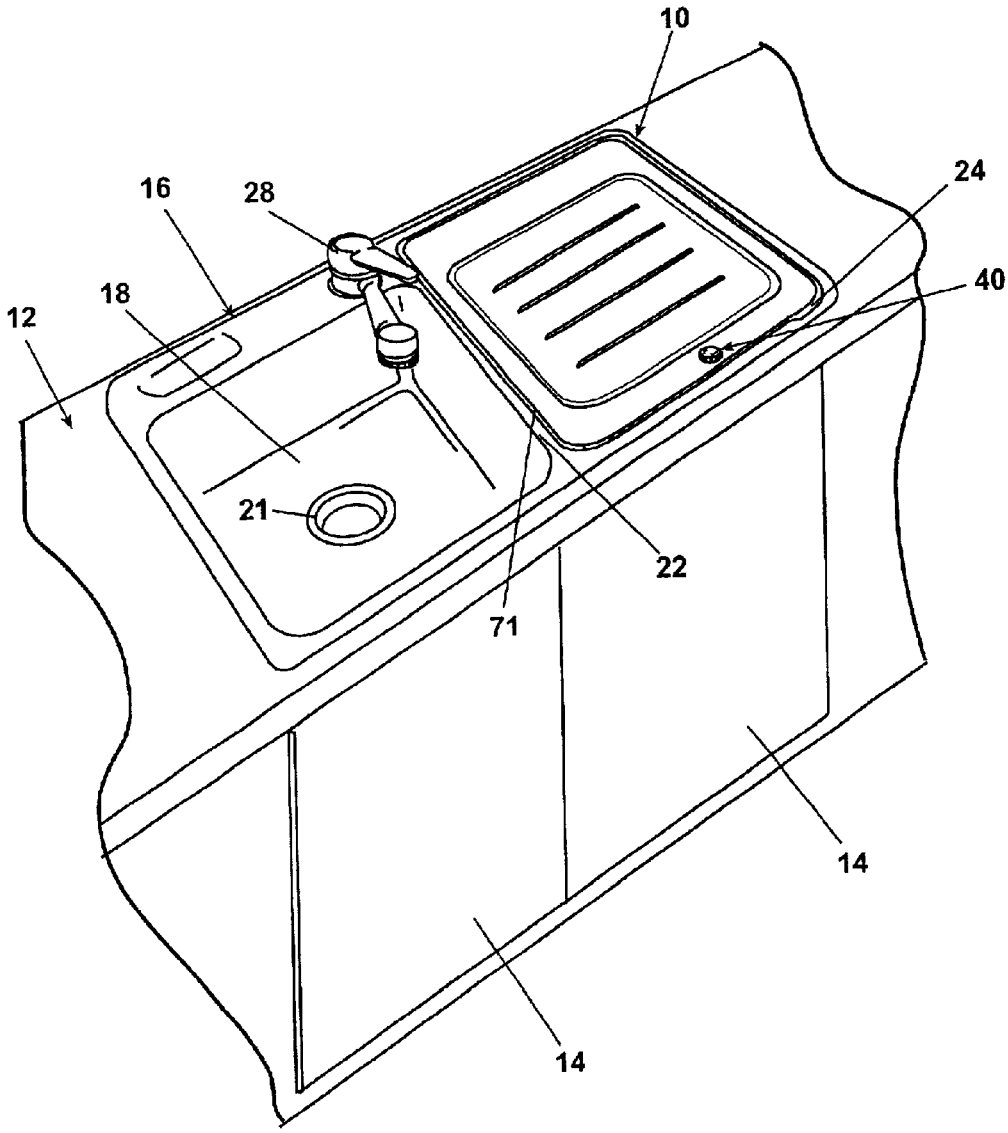
FIG. 2 is a perspective view substantially identical to FIG. 1 except that the lid is shown in the closed position.

Referring to FIGS. 1 and 2, the in-sink dishwasher 10 comprises a wash chamber 30 that is defined by the second bowl 18, which has an open top. A lid 32 is hingedly mounted to the peripheral flange 24 of the double-bowl sink 16 and is movable between an opened position as shown in FIG. 1 and a closed position as shown in FIG. 2 to selectively close the open top.

Figure 4:
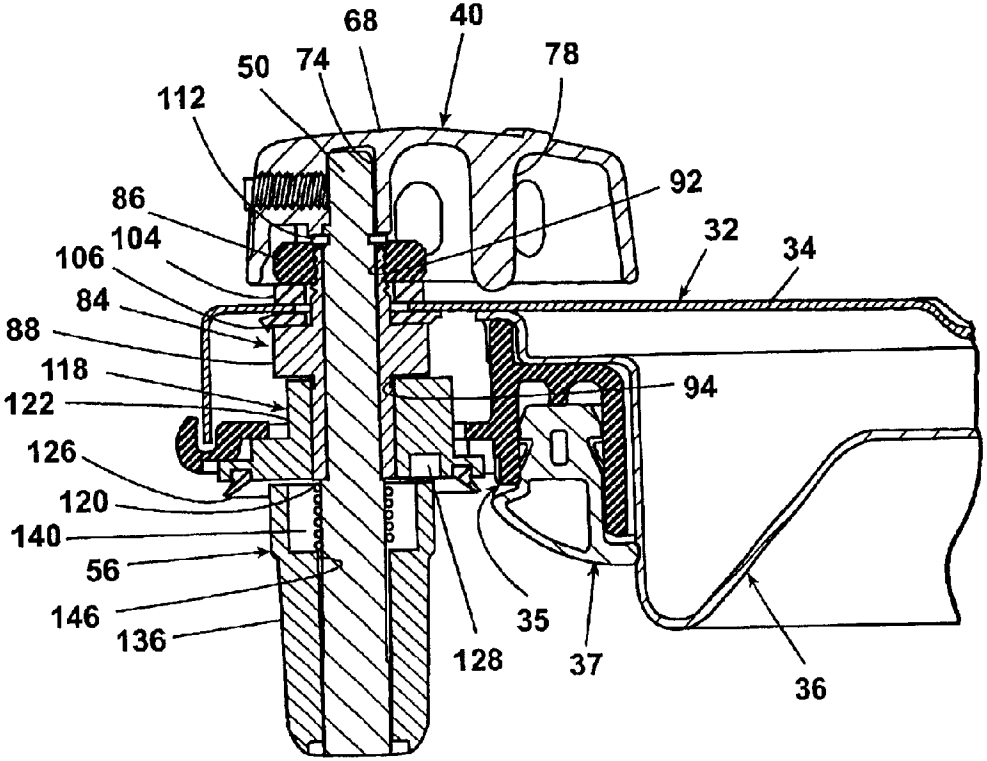
FIG. 4 is a sectional view of the strike mounted in the lid.

Referring to FIG. 4 specifically and FIGS. 1 and 2 generally, the lid 32 comprises an upper surface 34 and lower surface 36, with the lower surface 36 facing the wash chamber when the lid 32 is closed. The upper and lower surfaces are mounted to a frame 35. A seal 37 extends downwardly from the frame 35 and contacts the sink when the lid is closed to form a seal between the lid and the sink. Lid 32 may be provided with counterbalancing means, not shown, to support the lid in an upright position as shown in FIG. 1 and for preventing lid 32 from slamming down to the closed position in FIG. 2.

Figure 3:
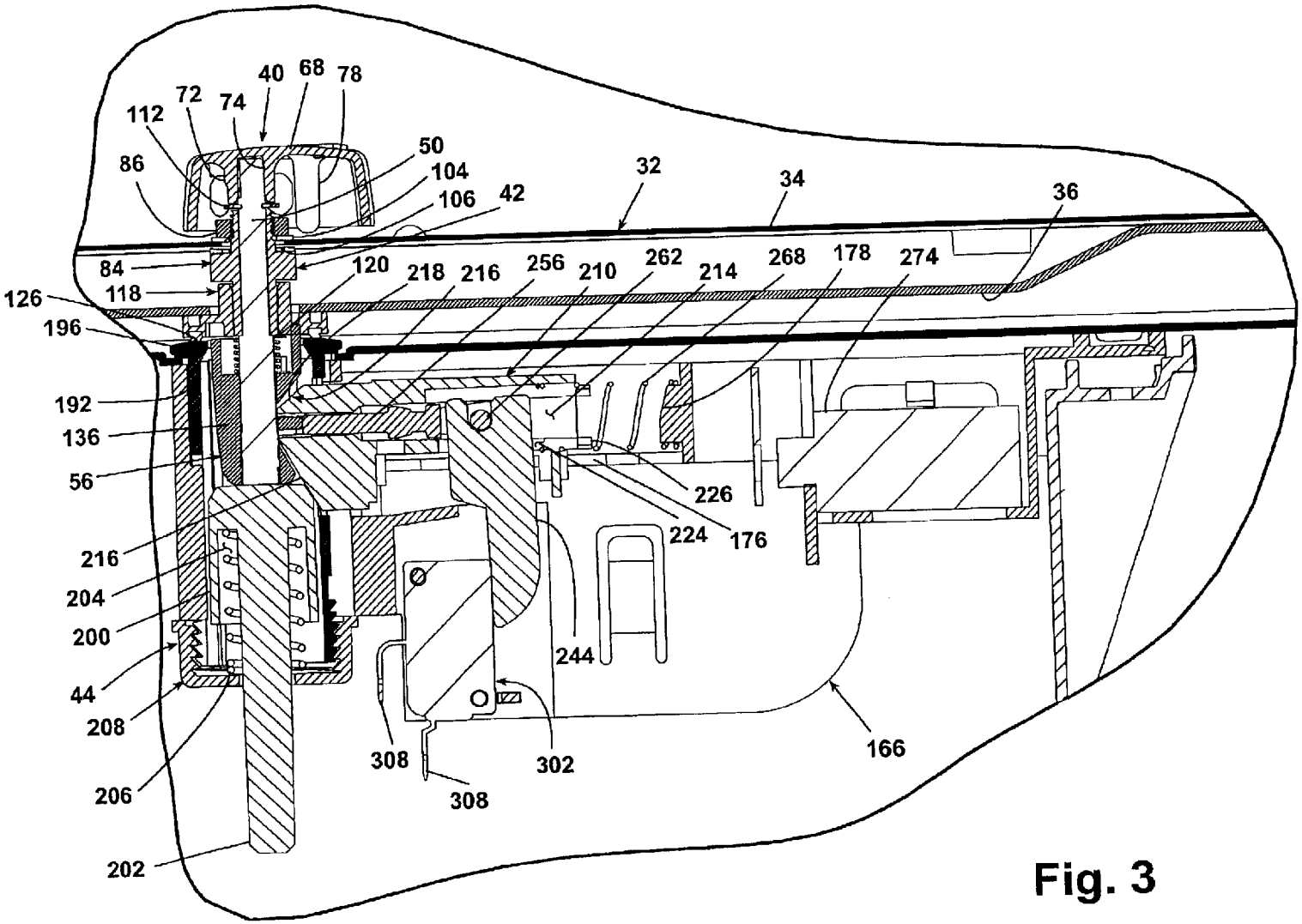
FIG. 3 is a partial sectional view illustrating the lid in the closed position, the strike in a latched position, and the catch engaging the strike.

The in-sink dishwasher 10 includes a latch 40 for securing the lid 32 in the closed position as seen in FIG. 2. The latch 40 comprises a strike 42 mounted to the lid 32 and a catch 44 mounted to the sink 16. The catch 44 engages the strike 42 when the lid 32 is closed to hold the lid in the closed position. As seen in FIG. 3, the lid is in the closed position and the catch 44 is engaged with the strike 42, which is in a latched position.

Figure 5:
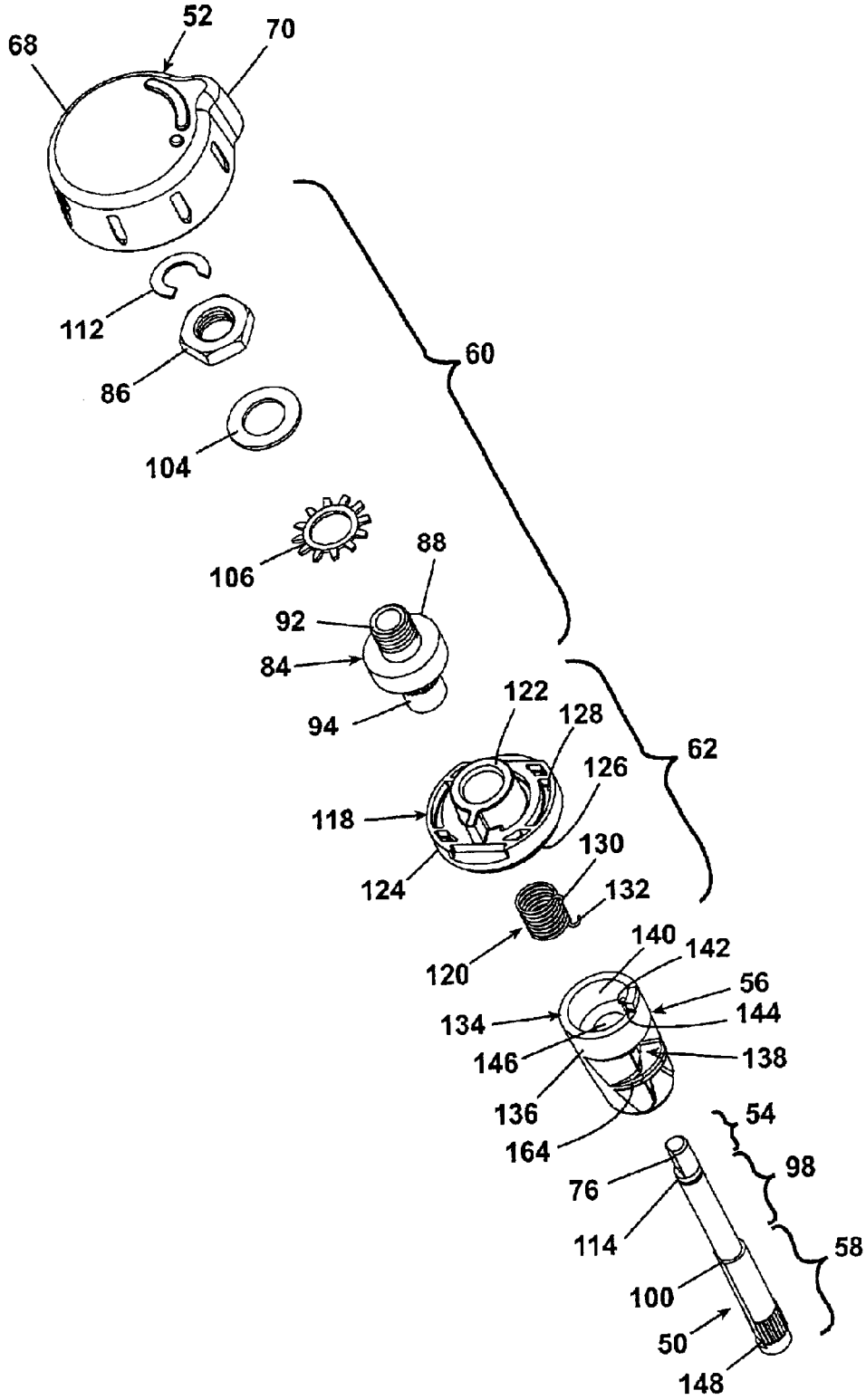
FIG. 5 is an exploded view of the strike for the latch.
Figure 6:
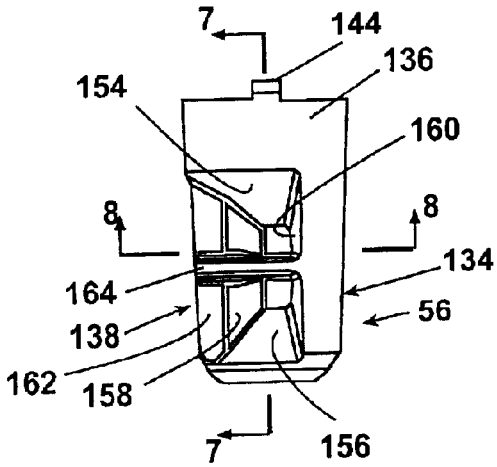
FIG. 6 is a side view of a strike face of the strike and showing a notch for receiving the catch when the strike is in the latched position.
Figure 7:
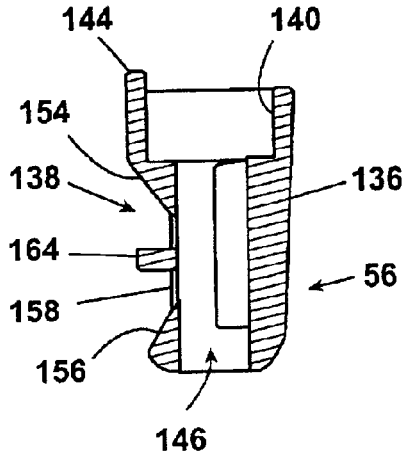
FIG. 7 is a sectional view of the strike face taken along line 7—7 of FIG. 6.
Figure 8:
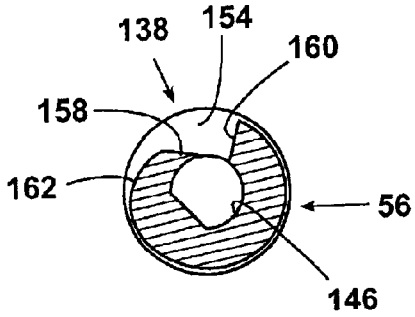
FIG. 8 is a sectional view of the strike face taken along line 8—8 of FIG. 6.

The various components comprising the strike 42 are best seen in FIG. 5, with general reference being made to FIGS. 3 and 4. The strike 42 comprises a central shaft 50 on which all of the other components are mounted. The shaft 50 passes through the lid 32 and mounts a handle 52 on an upper end 54 and a strike face 56 on a lower end 58. A mounting assembly 60 mounts the shaft 50 to the lid 32 and a biasing device 62 biases the strike face 56 into the latched position. Alternately, the biasing device 62 can be arranged to bias the strike face into the unlatched position.

The handle 52 is preferably a dome-shaped knob 68 having a pointer 70 for indexing the knob 68 relative to indicia on the lid 32. A collar 72 extends from the interior of the knob 68 at an eccentric location and defines a recess 74 having a generally D-shaped cross section that corresponds to the cross section of the shaft upper end 54 which includes a flat 76. A stop 78 extends from the interior surface of the knob 68 and terminates at a position slightly beyond the lower end of the knob 68.

The knob 68 is mounted to the shaft 50 by inserting the upper end 54 of the shaft 50 into the recess 74 of the collar 72. The complementary cross sections of the recess 74 and the shaft upper end 54 aid in aligning the knob 68 to the shaft 50 and preventing the relative rotation between the knob 68 and the shaft 50.

The stop 78 prevents the knob 68 from contacting the upper surface of the lid upon a downward force applied by the user. Preferably, the stop 78 is radially located and the rotation of the knob is limited such that the path traversed by the stop always lies inside the knob 68 throughout the entire range of rotation of the knob 68. Thus, if contact between the stop 78 and the lid mars the upper surface of the lid, the marring is hidden beneath the knob 68.

The eccentric mounting of the knob 68 to the shaft 50 provides the knob with a greater lever arm to reduce the amount of force that the user must apply to rotate the knob 68 against the force of the biasing device 62.

The mounting assembly 60 comprises a bushing 84 that is compressively mounted to an upper surface of the lid 32 by a nut 86. The bushing 84 comprises an annular shoulder 88 from which extends a hollow stem having a threaded upper portion 92 and a knurled lower portion 94. The hollow interior of the stem is sized to slide over the shaft upper end 54 and a shaft central portion 98 and abut a shoulder 100 formed by the junction of the shaft lower end 58 and middle portion 98.

The mounting assembly 60 further comprises a spring washer 106 and a traditional flat washer 104. The flat washer 104 is positioned between the nut 86 and the exterior of the upper surface 34. The spring washer 106 is placed between the shoulder 88 and the interior of the upper surface 34.

The mounting assembly 60 is secured to the upper surface 34 of the lid 32 by placing the spring washer 106 over the threaded portion 92 of the bushing 84 and inserting the threaded portion 92 through an opening in the lid upper surface 34, and then placing the flat washer 104 over the threaded portion 92 and threading the nut 86 onto the threaded portion 92 to draw the shoulder 88 and spring washer 106 against the interior of the upper surface 34 and compressively retain the upper surface 34 between the flat washer 104 and the spring washer 106. The opening in the upper lid surface 34 can be slightly oversized to permit alignment of strike 42 and catch 44.

The shaft 50 is secured to the mounting assembly 60 by a snap ring 112 that is received within a groove 114 formed in the shaft 50 in the middle portion 98 just below the upper portion 54. The snap ring 112 is snapped into the groove 114 after the shaft 50 is inserted through the hollow interior of the bushing 84 and when the groove 114 extends above the threaded portion 92 of the bushing 84. In this position, the snap ring 112 will abut the upper end of the threaded portion 92 and prevent the withdrawal of the shaft 50 from the bushing 84 unless the snap ring 112 is removed.

The biasing device 62 comprises a collar 118 and a torsion spring 120. The collar 118 includes a central annulus 122 and from which extends an annular flange 124. A seal 126 extends away from a lower surface of the annular flange 124. As best seen in FIG. 4, an arcuate keyway 128 is formed in a lower surface of the annular flange 124 and is located radially inwardly of the seal 126.

The central annulus 122 has an inner diameter that corresponds to the outer diameter of the knurled portion 94 of the bushing 84. The collar 118 is mounted to the bushing 84 by sliding the central annulus 122 over the knurled portion 94 of the bushing 84 to press-fit the collar 118 to the bushing 84.

The torsion spring 120 is a typical coil spring having upper and lower connectors 130, 132, respectively.

The strike face 56 comprises a substantially cylindrical body defining an outer peripheral surface 136 in which is formed a notch 138 for receiving the catch 44 when the strike face is in the latched position. The cylindrical body 134 has a slight arcuate taper and terminates in a rounded shoulder at a lower end. A recess 140 is formed in an upper end of the cylindrical body and is sized to receive the torsion spring 120. A spring catch 142 is located within the recess 140 and mates with the lower connector 132 of the torsion spring 120 to secure the torsion spring 120 to the strike face 56. A key 144 extends upwardly away from an upper edge of the strike face 56 and is received within the arcuate keyway 128 of the collar 118 for the biasing device 62 thereby limiting the range of rotation of the strike face 56 to the range of travel within the arcuate keyway 128 of the collar 118.

The strike face 56 further comprises a central through opening 146 sized to slidably receive the lower end 58 of the shaft 50, which has a knurled portion 148 that is press-fit within the through opening 146 to axially hold the strike face on the lower portion 58 of the shaft 50 and prevent the relative rotation of the strike face 56 and the shaft 50. The through opening 146 and knurled portion 148 both have a D-shaped cross section to aid in aligning the strike face 56 relative to the shaft 50.

Referring to FIGS. 4–7, the structure of the notch 138 for the strike face 56 is shown in greater detail. The notch 138 comprises tapered upper and lower walls 154, 156 that extend from the peripheral surface 136 into a rear wall 158, with part of the notch 138 being open to the through opening 146. A rear end wall 160 extends inwardly from the peripheral surface 136 to the rear wall 158. A cam surface 162 extends from the peripheral surface 136 to the rear wall 158. The cam surface 162 effectively functions as an opening or path into the notch 138. The cam surface 162 tangentially intersects the peripheral surface 136 and directly intersects the rear wall 158. A radially extending rib 164 divides the notch 138 into an upper and lower portion.

Figure 9:
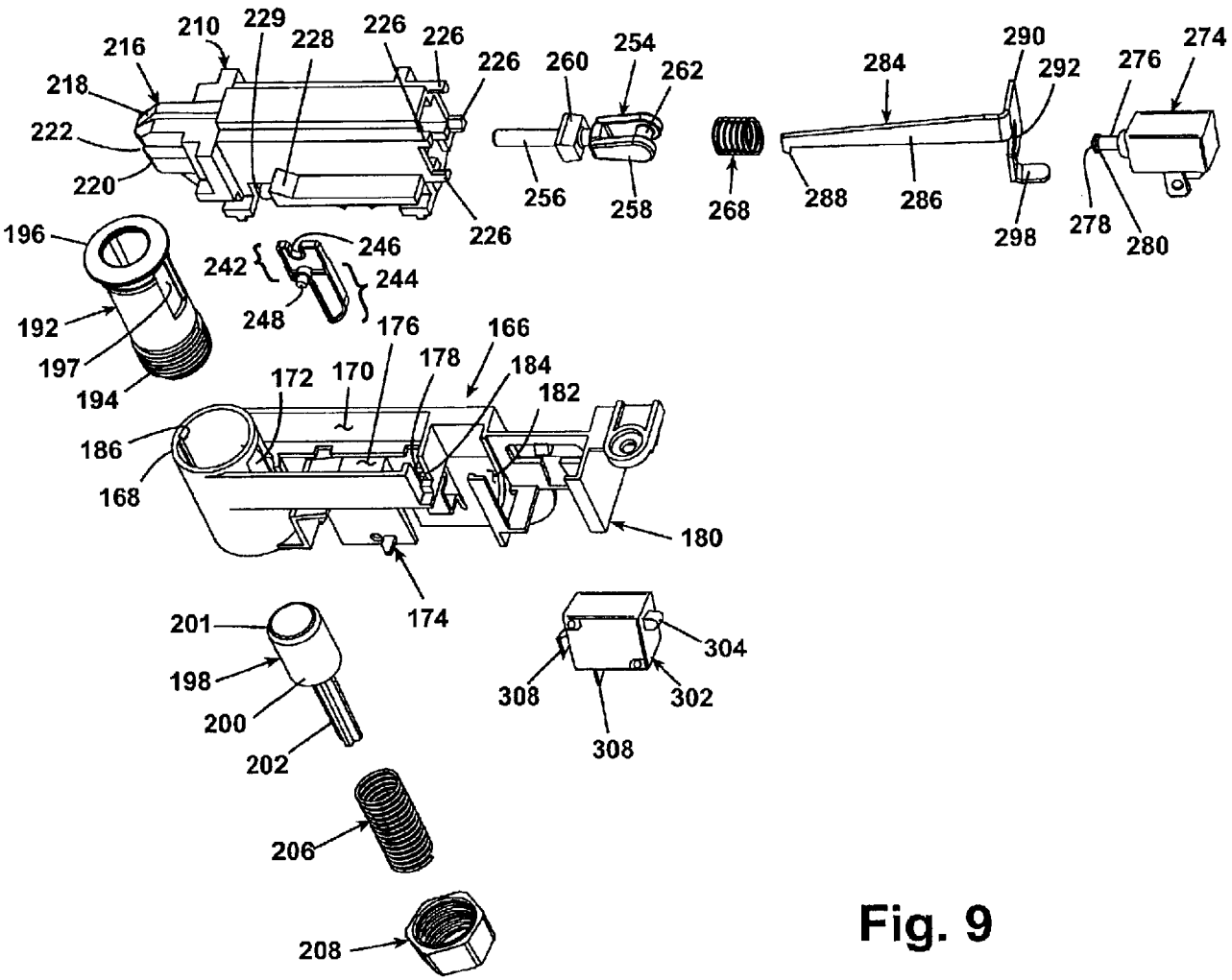
FIG. 9 is an exploded view of the catch for the latch as seen in FIG. 3.
Figure 10:
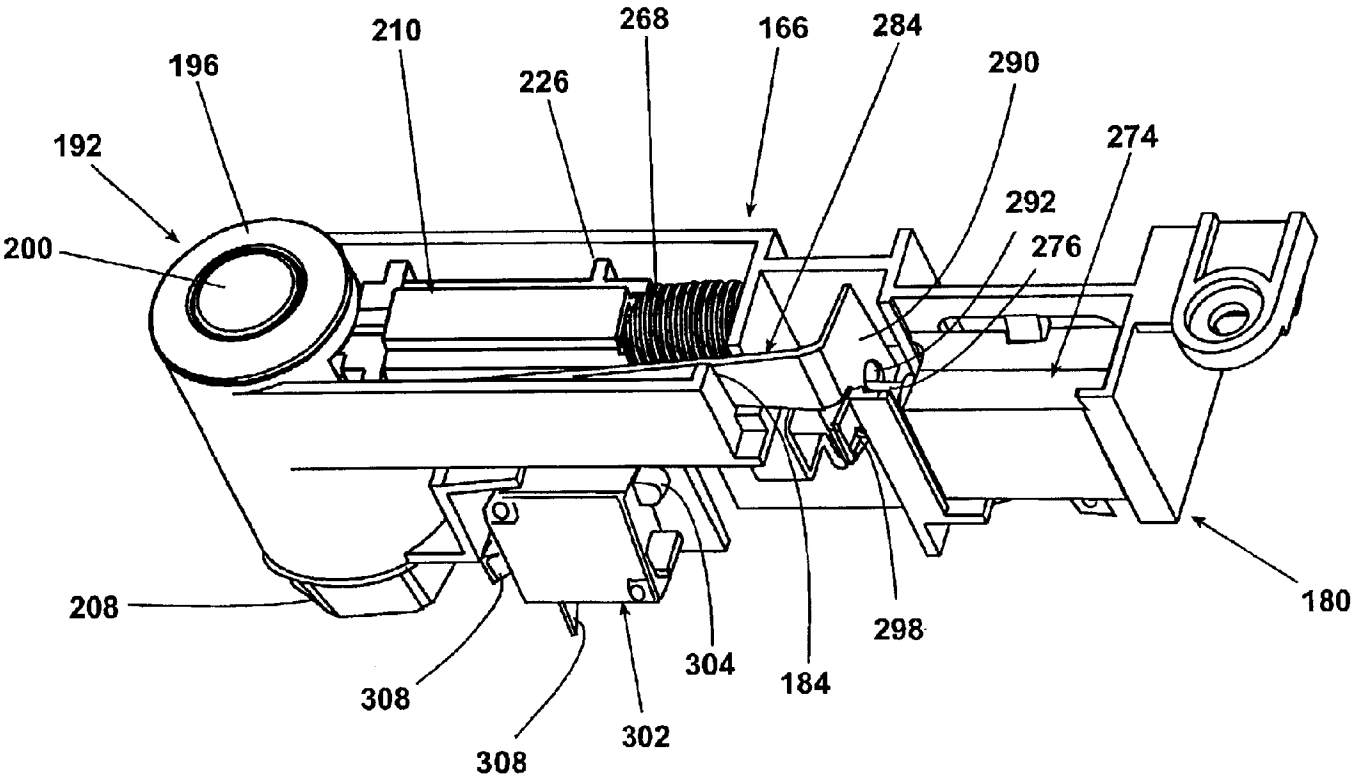
FIG. 10 is an assembled, top perspective view of the catch of FIG. 6.

FIGS. 3 and 9–10 disclose the catch 44 and its various components in greater detail. The catch 44 comprises a housing 166 that integrally forms or to which are mounted all of the components for the catch 44. The housing 166 includes a sleeve 168, located at one end of the housing 166, and a slider recess 170 that is in communication with the interior of the sleeve 168 through an opening 172 formed in the sleeve. A switch mount 174 is formed in the housing 166 and located below a bottom opening 176 in the slider recess 170. A spring seat 178 is located in an end of the slider recess 170 opposite the sleeve 168. A motor mount 180 is formed in the housing 166 adjacent the slider recess 170 and has an opening 182 that is generally aligned with a slot 184 in communication with the slider recess 170.

The catch 44 further comprises a plunger assembly that comprises a guide 192 with a threaded lower end 194 and a shoulder 196 forming an upper end. An opening 197 is formed in the side of the guide 192. A plunger 198 comprising a head 200 mounted to a rod 202 is received within the guide 192. An annular channel 204 is formed between the head 200 and the rod 202. A coil spring 206 is slidably received over the rod 202, with an end of the spring 206 being received within the annular channel 204. An internally threaded cap 208 completes the plunger assembly and threads onto the threaded lower end 194 of the guide.

The plunger assembly is mounted to the housing 166 by inserting the guide 192 through an opening in sink flange 24 and into the sleeve 168 until the shoulder 196 abuts the upper surface of the sink flange 24 and the upper end of the sleeve 168 abuts the underside of the sink flange 24 and the opening 197 aligns with the sleeve opening 172. The sleeve includes a key 186 that is received within a corresponding slot in the side of the guide 192 to align the guide opening 197 with the sleeve opening 172. The plunger 198 is inserted into the interior of the guide 192 through the threaded lower end 194. The coil spring 206 can be mounted to the rod 202 of the plunger 198 before or after the plunger 198 is inserted within the guide 192. The cap 208 is threaded onto the threaded lower end 194 of the guide 192 to retain the guide 192 and sleeve 168 of the housing 166 to the sink flange 24.

The catch 44 also comprises a slider 210 that has a box-like cross-section defining a hollow interior 214. The slider 210 terminates on one end with a tapered nose 216 defined by upper and lower tapered surfaces 218, 220, which are separated by an opening 222, which is connected to the interior 214 of the slider 210. The slider terminates on an opposite end with spring mounts 226. A ramp 228 extends laterally from the side of the slider and includes a contact surface 229.

Figure 11:
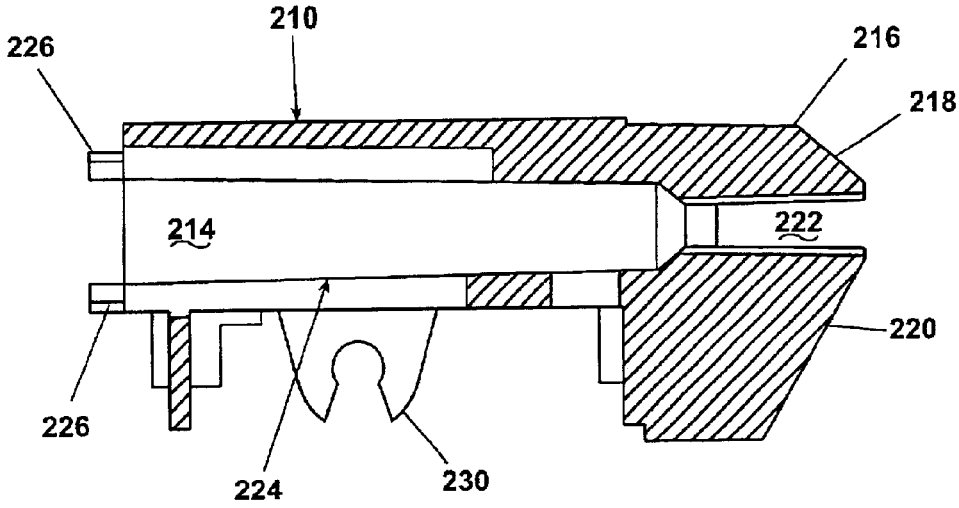
FIG. 11 is a side sectional view of a slider shown in FIG. 9.
Figure 12:
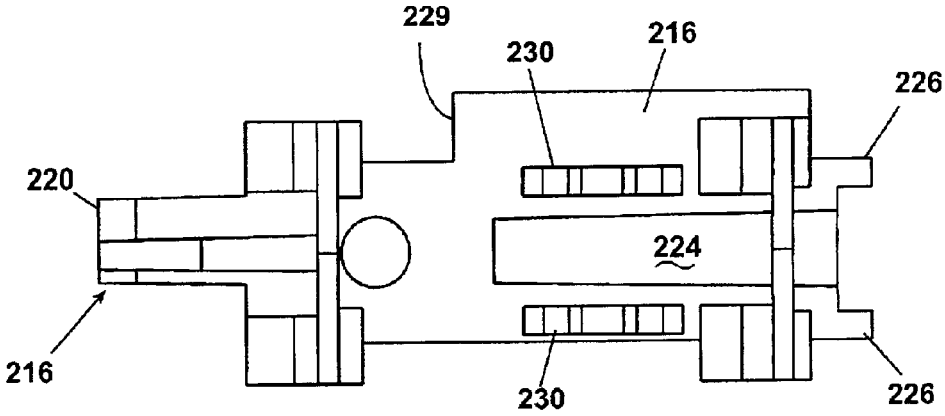
FIG. 12 is a bottom view of the slider shown in FIG. 11.

Referring to FIGS. 10 and 11, a lower opening 224 extends through a bottom of the slider 210 and is in communication with the interior 214. A pair of detents 230 extend downwardly from the slider 210 and are located on opposite sides of the opening 224.

Referring again to FIG. 9, the catch 44 additionally comprises a switch lever. The switch lever comprises a main body 242 from which extends a finger 244. A notch 246 is formed along an upper edge of the main body 242 and an axle 248 extends laterally from the main body 242. The axle 248 is received in the detents 230 of the slider 210 to snap-fit the switch lever to the slider 210 such that the switch lever can rotate relative to the slider 210 about the axis of the axle 248.

The catch 44 also includes a second or interior slider 254 that is sized to be received within the hollow interior 214 of the first slider 210. The inner slider 254 includes a pin 256 having a clevis 258 located on one end, with a stop 260 positioned in front of the clevis 258. The stop 260 functions to limit the relative travel of the inner slider 254 within the hollow interior 214 of the first slider 210. The clevis includes an axle 262 that is sized to be received within the notch 246 of the switch lever when the inner slider 254 is slidably received within the hollow interior 214 of the first slider 210.

A coil spring 268 is positioned within the slider recess 170 such that one end of the coil spring is mounted to the spring seat 178 and the other end of the coil spring is received within the spring mounts 226. The coil spring 268 urges the slider 210 toward the sleeve 168, resulting in the slider nose 216 being biased through the sleeve opening 172 and guide opening 197 and into the interior of the guide 192 thereby biasing the slider 210 toward the engaged position.

A motor 274 is mounted within the motor mount 180 of the housing 166. The motor 274 includes a reciprocating actuator 276 that can be extended and retracted from the motor 274. The actuator 276 terminates in a head 278 having an annular groove 280.

A connecting lever 284 operably couples the motor 274 to the slider 210 such that the withdrawal of the actuator 276 of the motor 274 results in a corresponding movement of the slider 210. The lever 284 comprises a body 286 that terminates in a hook 288 on one end and a mounting flange 290 on another end. The mounting flange 290 comprises an opening 292 sized to receive the head 278 of the actuator 276. A tab 298 extends from a lower edge of the mounting flange 290 and abuts a portion of the housing 166 forming the rear of the slider recess 168 when the actuator 276 is withdrawn into the motor 274.

The actuator 276 is coupled to the lever 284 and the head 278 through the opening 292 by inserting the edge defining the channel 280 of the head 278 into the secondary opening 292. The extension of the actuator 276 extends the hook 288 on the lever 284 up over the ramp 228, until the hook 288 lies on the opposite side of the ramp 228. The retraction of the actuator 276 pulls the hook 288 of the lever 284 toward the motor 274 where the hook 288 engages the ramp 228 and pulls the slider 210 toward the motor 274.

Preferably, the lever 284 is positioned such that the hook 288 abuts the contact surface 229 and the motor 274 retracts the actuator 276 into the motor 274 to pull the slider 210 toward the motor 274. The motor must have sufficient force to overcome the spring 268, which biases the slider 210 toward the engaged position as well as the friction of strike 24 and plunger 198 moving against the slider nose 216. The motor 274 is preferably a wax motor. As motor 274 retracts the actuator 276 thereby causing lever 284 to withdraw slider 210, slider 210 withdraws sufficiently to release the strike 24. When strike 24 is released, plunger 198 pushes the strike up and then plunger 198 continues to rise pushing slider 210 inward and relieving pressure on lever 284. Motor 274 continues to retract actuator 276 and lever 284 until tab 298 hits the wall forming the motor mount 180 causing lever 284 to tip up disengaging hook 288 from ramp 228 thus resetting the motor for the next cycle.

A power switch 302 is mounted to the switch mount 174 of the housing 166. The power switch 302 comprises a manually depressible switch 304 and electrical connectors 308. The depressible switch 304 lies within the path of movement of the finger 244 of the switch lever. When the depressible switch 304 is depressed by the finger 244, power is supplied through the electrical connectors 308. When the depressible switch 304 is not depressed, power is not permitted to pass through the electrical connectors 308.

The operation of the latch 40 will now be described with respect to FIGS. 3, 13 and 14. For purposes of the description, it is assumed that the lid 32 is in the closed position, the strike 42 is in the latched position, and the catch 44 is engaging the strike 42, all of which are disclosed in FIG. 3. When the strike 42 is in the latched position, the strike face 56 is substantially completely received within the interior of the guide 192 by passing through the open upper end defined by the shoulder 196. The strike face 56 is oriented within the guide 192 such that the notch 138 faces the side opening 197 of the guide 192 and the sleeve opening 172 of the sleeve 168. In other words, the notch 138 is accessible by the tapered nose 216 of the slider 210 through the aligned guide opening 197 and sleeve opening 172.

The strike face 56 is preferably biased into the latched position by the biasing device 62. Alternately, as mentioned above, the strike face can be biased to the unlatched position The torsion spring 120 of the biasing device 62 rotates the strike face 56 and the shaft 50 until the key 144 of the strike face abuts the end of the arcuate keyway 128 and the collar 118 for the biasing device 62.

The catch 44 engages the strike 42 when the tapered nose 216 of the slider 210 is received within the notch 138 such that the tapered nose 216 extends a radial distance into the notch 138 sufficient to abut with the end wall 160 upon the relative rotation of the strike face 56. Preferably, the tapered nose 216 is received within the notch 138 such that the rib 164 is received within the nose opening 222 and the end of the upper and lower surfaces 218, 220 abut the rear wall 158 of the notch 138 as shown in FIG. 3.

When the slider 210 engages the strike face 56 as illustrated in FIG. 3, the radial rib 164 contacts the pin 256 of the inner slider 254 and displaces the interior slider 254 rearward within the hollow interior 214 of the slider 210. The rearward movement of the inner slider 254 rotates the switch lever about the axle 248 to rotate the finger 244 into contact with the switch 304 of the power switch 302 to depress the switch 304 and permit electrical power to be transferred through the electrical connectors 308. Thus, when the slider 210 engages the strike face 56, electrical power can pass through the power switch 304.

The plunger 198 is moved away from the shoulder 196 when the lid is in the closed position by the receipt of the strike face 56 extending within the interior of the guide 192. The lower end of the strike face 56 abuts the upper surface 201 of the plunger head 200 to push the plunger 198 toward the cap 208 and simultaneously compressing the coil spring 206. It is preferred that the coil spring 206 have sufficient strength such that it raises the strike face 56 out of the guide 192 an amount sufficient to break the seal between the lid and the sink when the slider 210 is not engaged with the strike face 56. It is most preferred that the force of the coil spring 206 is sufficient to raise the lid 32 by moving the strike face 56.

Figure 13:
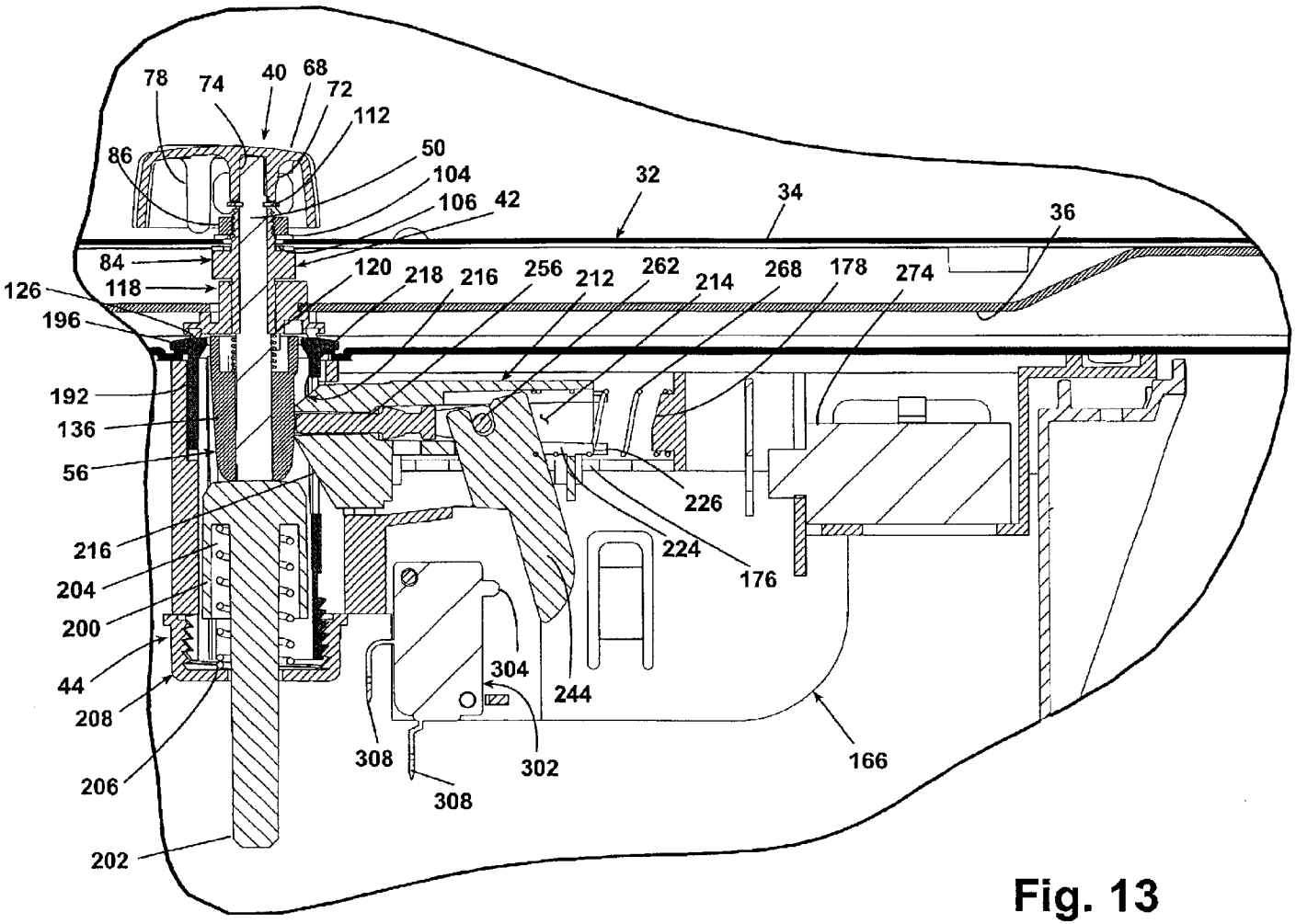
FIG. 13 is a partial sectional view similar to FIG. 3 with the lid in the closed position and the strike in a released position with the catch disengaged from the strike.

FIG. 13 illustrates the lid 32 in the closed position but with the strike face 56 in the released position. The lid 32 and strike face 56 will take this position just prior to the lifting of the lid out of the closed position. The strike face 56 can be moved to the released position only by the manual manipulation of the handle 52. The handle must be rotated against the force of the biasing device 62 to rotate the strike face 56 from the latched position as seen in FIG. 4 to the released position as seen in FIG. 13.

If the biasing means is alternately arranged to bias the strike face to the unlatched position, as mentioned above, handle 52 must be manipulated against the friction of slider 210 in strike face 56 to move strike face 56 to the latched position. Thus, the mere closing of the lid 32 will not effect the latching of the lid 32 unless the user rotates the handle 52 to the latched position.

The user moves the strike face 56 into the released position as seen in FIG. 13 by grasping and rotating the handle 52. As the handle 52 is rotated, the cam surface 162 is brought into contact with the tapered nose 216 of the slider 210. The rotation of the handle 52 is continued until a portion of the peripheral surface 136 of the strike face 56 contacts the tapered nose 216 of the slider 210. The pin 256 of the interior slider 254 is effectively always located at the peripheral surface since the radial rib 164 contacting the pin 256 terminates at the peripheral surface of the strike face 56. As the strike face 56 is rotated by the user to the released position, the tapered nose 216 follows the cam surface 162 until it contacts only the peripheral surface 136, which slides the slider 210 rearwardly against the force of the coil spring 268 relative to the inner slider 254. The relative reward movement of the slider 210 with respect to the inner slider 254 results in the counterclockwise pivoting (as seen in FIG. 13) of the switch lever because the edge of the slider defining the bottom opening 176 contacts the main body 242 of the switch lever. The counterclockwise pivoting of the switch lever 240 removes the finger 244 from contact with the switch 304 for thereby discontinuing the flow of electrical power through the electrical connectors 308.

The catch 44 can be disengaged from the strike 42 by use of the motor 274 to withdraw the slider 210 from the notch 138 if it is desired to automatically disengage the catch 44 from the strike 42 instead of relying on the user to manually rotate the strike 42 from the latched to the released position. When the motor 274 is energized, the actuator 276 is retracted into the motor 274, which draws the lever 284 toward the motor 274 causing the hook 288 to engage the contact surface 229 of slider 210 and move the slider 210 towards the motor 274 against the biasing of the coil spring 268. As the slider 210 is moved towards the motor 274, the nose 216 is withdrawn from the notch 138. As the nose 216 of the slider 210 clears the notch 138, the strike face 56 remains in the latched position since the biasing device 62 automatically biases the strike face 56 to the latched position. However, since the tapered nose 216 of the slider 210 is removed from the notch 138, the lid 32 is free to be moved from the closed position toward the open position. As in the case of manual rotation of the strike 42, when slider 210 is withdrawn the switch lever is rotated counterclockwise removing finger 244 from switch 304 thereby discontinuing flow of electrical power through the connectors 308.

Figure 14:
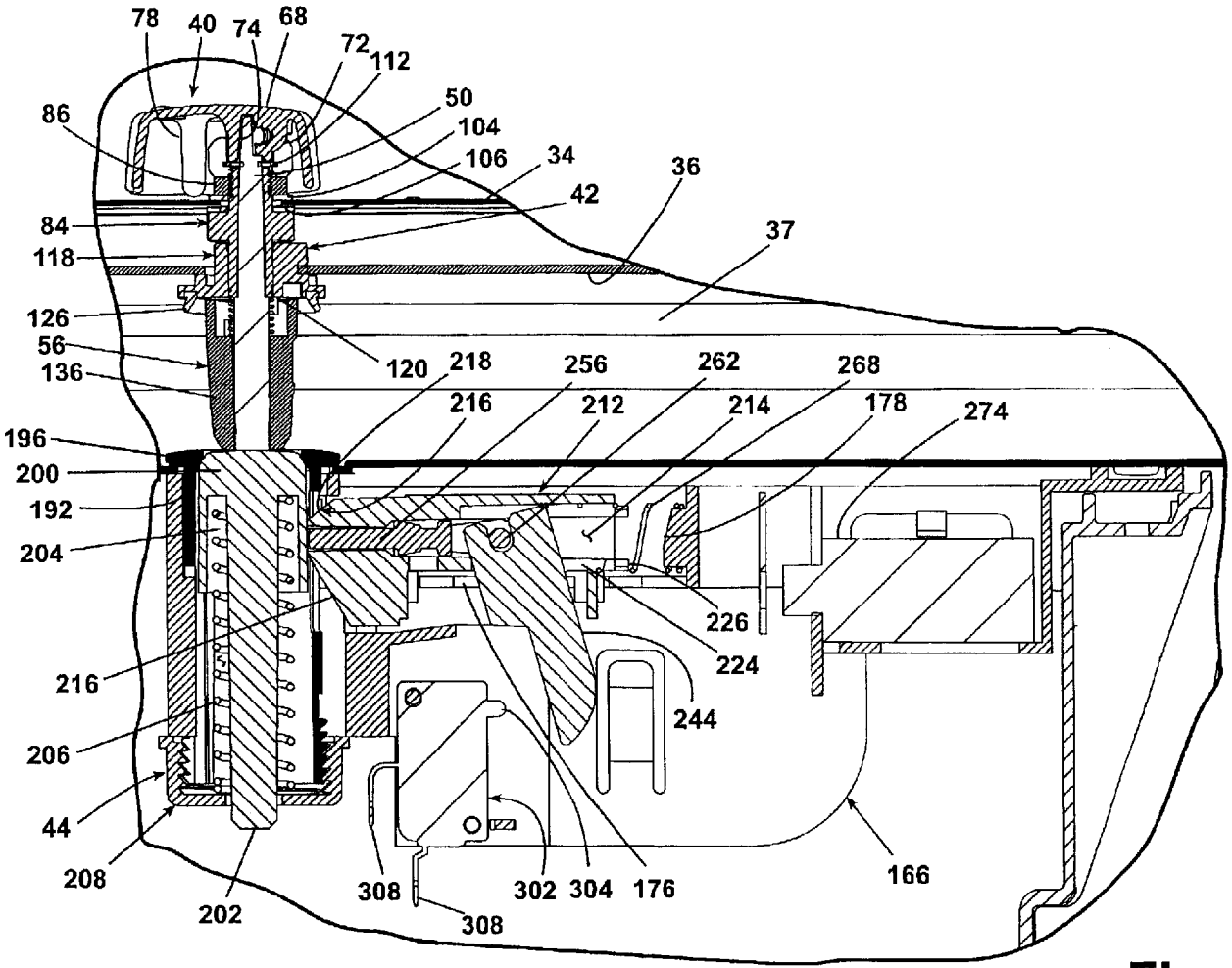
FIG. 14 is a partial sectional view similar to FIG. 7 with the lid in a partially-opened position.

Referring to FIG. 14, regardless of whether the catch 44 is disengaged from the strike 42 manually by the user or automatically by the motor, once the slider 210 is removed from the notch 138, the plunger 198 is urged upwardly by the force of the coil spring 206 until the head 200 contacts the shoulder 196 of the guide 192. As the plunger 198 is moved upwardly within the guide 192, the strike face 56 is carried along with the plunger 198 to thereby lift the lid 32 from the closed position of FIG. 13 to the partially open position of FIG. 14. If the user desires, the user can continue the rotation of the lid from the partially open position to the fully open position as shown in FIG. 1.

Figure 15:
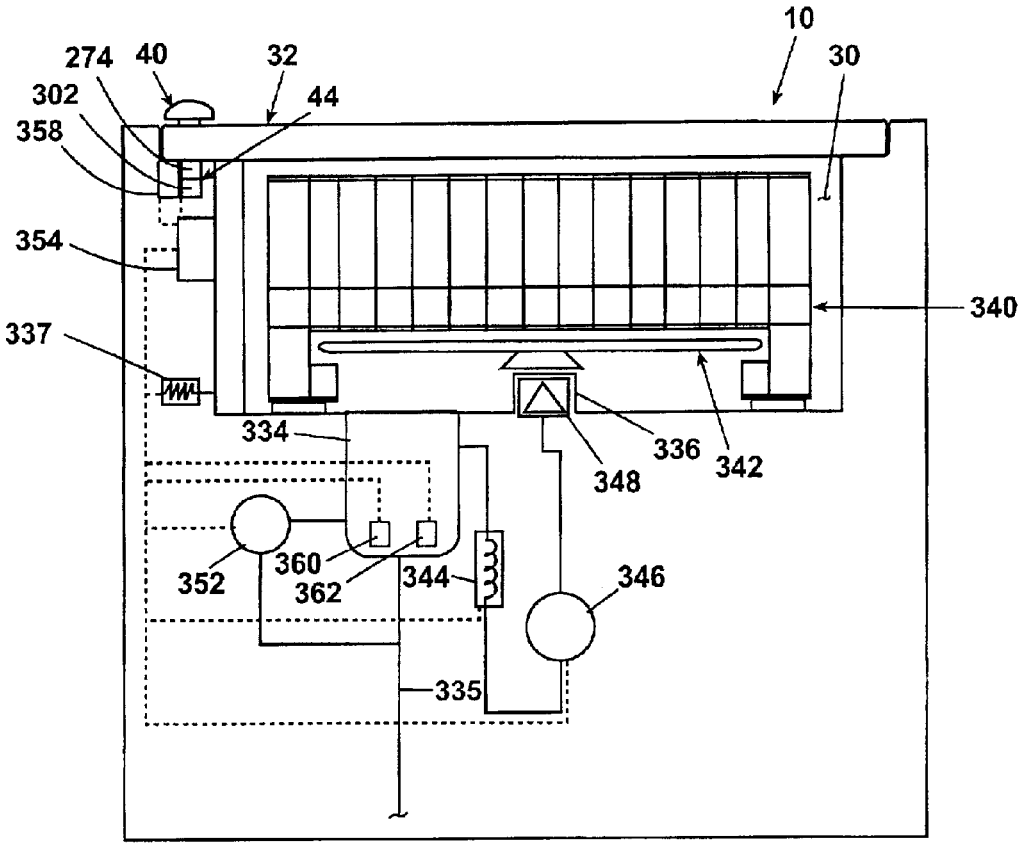
FIG. 15 is a schematic illustrating a controller for operating the in-sink dishwasher including the automatic release of the latch.

FIG. 15 schematically illustrates a simple control system for operating the in-sink dishwasher, including the automatic opening of the lid 32, along with some components of the in-sink dishwasher. The in-sink dish washer further comprises a drain 334 along with a recirculation inlet 336 provided in the bottom of the second bowl 20 for the draining and recirculation of water from and into the wash chamber 30. The drain 334 is coupled to a drain line 335 that serves as a drain during the use of the bowl 20 as a traditional sink and when used as a wash chamber 30 for the in-sink dishwasher 10. A fill valve 337 is provided in the side of the bowl 20 and is connected to a household water supply. The fill valve 337 introduces a charge of water into the bowl and which is used to rinse the dishes or mixed with detergent to wash the dishes.

A rack 340 comprised of multiple wire segments for holding various dishes and utensils. The exact shape and configuration of the rack 340 is not germane to the invention and is preferably made similar to those found in automatic dishwashers.

A spray arm 342 is preferably mounted to the bottom of the rack 340 such that the spray arm is free to rotate relative to the rack 340 and is removed from the wash chamber when the rack is removed. The spray arm 342 couples with the recirculation inlet 336 when the rack 340 is positioned within the second bowl 20.

The drain 334 has one outlet that is fluidly coupled to an in-line water heater 344. The output of the water heater 344 is received as input to a recirculation pump 346, whose output is sent to a valve 348 forming part of the recirculation inlet 336.

The drain 334, recirculation inlet 336, in-line water heater 344, recirculation pump 346, valve 348, and spray arm 342 collectively form a recirculation system for recirculating wash liquid throughout the wash chamber 30.

The drain 334 has another outlet that is fluidly connected to a drain pump 352. The output of the drain pump 352 is fluidly connected to the traditional drain line for the second bowl 20. The drain pump 352 provides for a positive draining of liquid from the wash chamber 30, such as, for example, when it is no longer desired to recirculate the wash liquid with the recirculation system.

A controller 354, preferably a microprocessor-based controller, is electronically coupled to the in-line heater 344, recirculation pump 346, and drain pump 352 to control their respective operations. If the valve 348 is an actuated valve, such as a solenoid-actuated valve, instead of a check valve, then the controller 354 can also be connected to the valve 348 and control its operation.

The controller 354 operates the in-line heater 344, recirculation pump 346, and drain pump 352 to implement a wash cycle. Preferably, the wash cycle is one of many well-known wash cycles stored in the memory of the microprocessor.

A user interface 358 is located adjacent the second bowl 20 and is electronically coupled to the controller 354. The user interface 358 permits the user to select the desired wash cycle from the multiple wash cycles stored in the memory of the microprocessor and enter any necessary or optional operating data or parameters for the wash cycles.

To operate the in-sink dishwasher 10, the user selects the desired cycle using the user interface 358. The controller then implements the selected cycle, which is normally stored in the memory of the microprocessor as multiple steps. The steps typically include the introduction of water, which is then recirculated in the wash chamber. If a rinsing step is desired, the water is recirculated. If a wash step is desired, then detergent is normally mixed with the water and recirculated. The in-line heater is used to heat the liquid if needed. A temperature sensor 360, such as a thermistor, can be used to provide the controller with information on the temperature of the liquid. A liquid level sensor 362, such as a pressure sensor, can also be used to provide the controller with information about the liquid level in the wash chamber. The controller will sequentially run the various steps of the selected cycle.

The controller can automatically initiate the opening of the lid 32, preferably upon the completion of the selected wash cycle, to flash dry the dishes. Flash drying the dishes requires that the wash chamber be fluidly connected to the ambient air to permit the water vapor in the wash chamber to be replaced with the ambient air and permit the transfer of heat from the wash chamber to the ambient air. At the end of the selected cycle having a flash dry step, the controller 354 energizes the motor 274 to move the slider 210 from the engaged to the disengaged position. Once the slider 210 is disengaged, the lid is moved to the partially open position shown in FIG. 14, as previously described, to fluidly connect the wash chamber to the ambient air and implementing the flash dry.

The movement of the slider 210 to the disengaged position also switches off the power switch 302, which will shut off electrical power to all of the components supplied power by the switch 304. It is preferred that at least the recirculation pump 346 is supplied power through the power switch 302 because the termination of power to the recirculation pump will prevent the spraying of liquid through the spray arm while the lid is partially or completely open. Also, if for any reason the user manually opens the lid 32 in the middle of the selected cycle, the recirculation pump will immediately shut off and prevent the spraying of liquid while the lid is opened.

Other components, as desired, can be supplied power by the power switch 302. For example, to prevent the filling of water into the wash chamber while the lid is partially open, the fill valve 337 could also be supplied power by the power switch 302. It is preferred that the controller 354 and user interface 358 not be supplied power through the power switch 302 to enable the user to select the desired wash cycle while the lid is open.

The in-sink dishwasher 10 and the latch 40 solve a very difficult problem for in-sink dishwashers. The in-sink dishwasher can still have a top-loading lid configuration with all of the functionality users have come to expect from traditional front-loading dishwashers. The latch 40 enables this functionality by having a small form factor that results from mounting the handle onto the strike, which greatly reduces the space in the lid and the sink needed for the strike and the catch. The location of the strike with the handle on the lid, in contrast to traditional dishwashers that locate the handle on the door and the strike on the cabinet, also reduces the form factor while still permitting the user to manually open and close the door.

While the invention has been specifically described in connection with certain specific embodiments thereof, it is to be understood that this is by way of illustration and not of limitation, and the scope of the appended claims should be construed as broadly as the prior art will permit.

What is claimed is:

1. A dish-cleaning appliance comprising:

a sink comprising a bottom wall and a peripheral side wall extending upwardly from the bottom wall to define a wash chamber, with the peripheral side wall defining a top opening providing access to the wash chamber;

a lid mounted to the sink and movable between an opened and a closed position to selectively cover the top opening when the lid is in the closed position, the lid having a lower surface and an upper surface, with the lower surface facing the bottom wall when the lid is closed; and a latch for holding the lid in the closed position, the latch comprising:

a strike rotatably mounted to the lid for rotation between a latched and a released position, a handle mounted to the strike and the handle is accessible by a user for rotating the strike between the latched and released position by manipulating the handle, and a catch mounted to the sink and engaging the strike when the lid is in the closed position and the strike is in the latched position, wherein the strike comprises a strike face extending beyond the lower surface of the lid and the catch engages the strike face when the strike is in the latched position to hold the lid in the closed position;

wherein the strike face comprises a notch in which the catch is received when the strike is in the latched position to effect the engagement between the strike and the catch and the strike face further comprises a cam surface leading to the notch and the catch comprises a laterally movable slider that moves laterally to follow the cam surface into and out of the notch as the strike is rotated between the latched and released positions to engage and disengage the catch from the strike; and whereby the user can grasp the handle and move the lid to the closed position where the strike, in the latched position, is engaged by the closed position, and the user can rotate the handle to rotate the strike to the released position, permitting the movement of the lid from the closed to the opened position.

2. The dish-cleaning appliance according to claim 1 wherein the strike face comprises a substantially cylindrical body having a peripheral surface, and the notch extends laterally from the peripheral surface into the cylindrical body, with the body defining a rear wall of the notch.

3. The dish-cleaning appliance according to claim 2 wherein the cam is a curved surface formed into the cylindrical body and extends from a tangential intersection with the peripheral wall to an intersection with the rear wall of the notch.

4. The dish-cleaning appliance according to claim 3 wherein the notch further comprises a top and a bottom wall, each extending from the peripheral surface to the rear wall and the top and bottom walls taper from the peripheral surface toward the rear wall.

5. The dish-cleaning appliance according to claim 4 wherein the slider has a tapered end and the tapered top and bottom walls of the notch guide the tapered end of the slider into the notch.

6. The dish-cleaning appliance according to claim 5 wherein the notch further comprises a radial rib extending from the rear wall of the notch to form a key, and the slider recess in the tapered end that forms a keyway in which the radial rib is received when the strike is in the latched position to help guide the slider into the notch.

7. The dish-cleaning appliance according to claim 6 and further comprising a power switch for supplying electrical power to the dish-cleaning appliance and which is mechanically coupled to the slider such that when the slider engages the strike face, the switch supplies power to the dish-cleaning appliance.

8. The dish-cleaning appliance according to claim 7 wherein the slider comprises a finger for actuating the power switch when the slider engages the strike face and the finger is moveable between an actuating position, corresponding to the slider engaging the strike face, and a non-actuating position, corresponding to the slider not engaging the strike face.

9. The dish-cleaning appliance according to claim 8 wherein the slider further comprises a secondary slider mounted for sliding movement relative to the slider and having one end extending into the slider recess and another end coupled to the finger, wherein when the rib is received within slider recess, the rib contacts the one end of the secondary slider to move the secondary slider relative to the slider and thereby move the finger into the actuating position.

10. The dish-cleaning appliance according to claim 6 and further comprising a first biasing device biasing the strike face into one of the latched and released positions.

11. The dish-cleaning appliance according to claim 10 wherein the biasing device biases the strike face into the latched position.

12. The dish-cleaning appliance according to claim 10 wherein the biasing device biases the strike face into the released position.

13. The dish-cleaning appliance according to claim 10 and further comprising a second biasing device biasing the slider into engagement with the strike face to automatically engage the strike face when the lid is closed.

14. The dish-cleaning appliance according to claim 13 and the strike further comprises a shaft extending through the lid, with an upper end extending beyond the upper surface and a lower end extending beyond the lower surface, and the handle is mounted to the upper end and the strike face being rotatably mounted to the lower end.

15. The dish-cleaning appliance according to claim 14 wherein the first biasing device is a torsion spring connected between the strike face and the shaft.

16. The dish-cleaning appliance according to claim 15 wherein the handle is a knob that is eccentrically mounted to the upper end of the shaft.

17. The dish-cleaning appliance according to claim 1 and further comprising a guide having a hollow interior with an inlet opening located in the sink such that the strike face is received within the guide through the inlet opening when the lid is in the closed position, thereby guiding the strike face into alignment with the slider.

18. The dish-cleaning appliance according to claim 17 and further comprising a lid-biasing device that biases the lid from the closed position to at least a partially open position when the strike face and slider are not engaged.

19. The dish-cleaning appliance according to claim 18 wherein the lid-biasing device comprises a plunger having a head located within the guide and a spring extending between a portion of the guide and the head to bias the head toward the inlet opening such that, when the strike face is received within the guide, the head bears against the strike face to urge the lid to the partially open position.

20. The dish-cleaning appliance according to claim 19 wherein the plunger has sufficient travel such that the head closes the inlet opening when the strike face is removed from the guide.

21. The dish-cleaning appliance according to claim 20 wherein the slider extends into the guide a sufficient distance such that the slider lies in the path of the plunger when the slider engages the strike face and the plunger contacts the slider and moves the slider laterally when the plunger moves the lid to the partially open position.

22. The dish-cleaning appliance according to claim 21 wherein the head of the plunger blocks the slider from laterally moving into the guide when the lid is not in the closed position.

23. The dish-cleaning appliance according to claim 22 and further comprising an actuator coupled to the slider for laterally moving the slider out of engagement with the strike face thereby permitting the lid-biasing device to move the lid to the partially open position.

24. The dish-cleaning appliance according to claim 23 wherein the actuator comprises a wax motor mounted to the sink and coupled to the slider.

25. The dish-cleaning appliance according to claim 23 and further comprising a slider biasing device biasing the slider into engagement with the strike face and the actuator must overcome the force of the slider-biasing device to move the slider out of engagement with the strike face.

26. The dish-cleaning appliance according to claim 23 and further comprising a power switch mechanically coupled to the slider such that when the slider is not engaged with the strike face, the slider actuates the power switch to shut off power to the dish-cleaning appliance.

27. The dish-cleaning appliance according to claim 26 wherein the catch further comprises a housing mounted to the sink to effect the mounting of the catch to the sink and the housing defines a channel in which the slider is received.

28. An in-sink dish-washer comprising:

a sink comprising a bottom wall and a peripheral side wall extending upwardly from the bottom wall to define a wash chamber, with the peripheral side wall defining a top opening providing access to the wash chamber;

a lid mounted to the sink and movable between an opened and a closed position to selectively cover the top opening when the lid is in the closed position, the lid having a lower surface and an upper surface, with the lower surface the bottom wall when the lid is closed;

a strike comprising a handle and a strike face, with the handle being directly connected to the strike face, the strike is mounted to the lid for rotation between a latched and a released position and the handle is spaced above the upper surface and the strike face is spaced below the lower surface when the lid is closed;

a catch mounted to the sink and engaging the strike face when the lid is in the closed position and the strike is in the latched position;

a first biasing device for biasing the strike face into one of the latched and released positions to ensure the strike face will be aligned for engagement by the catch when the lid is closed;

a second biasing device for biasing the catch into engagement with the strike face to provide for the automatic engagement of the catch with the strike face when the lid is closed;

whereby the user can grasp the handle and move the lid to the closed position where the strike, in the latched position, is engaged by the catch to hold the lid in the closed position, and the user can rotate the handle to rotate the strike to the released position, permitting the movement of the lid from the closed to the opening position.

29. The in-sink dishwasher according to claim 28 wherein the catch further comprises a movable slider that is biased by the second biasing device into engagement with the strike face to hold the lid in the closed position.

30. The in-sink dishwasher according to claim 29 wherein the strike face comprises a notch that is aligned with and receives the slider when the strike face is in the latched position.

31. The in-sink dishwasher according to claim 30 and the strike further comprises a shaft extending through the lid, with an upper end to which the handle is mounted, and a lower end to which the strike face is mounted.

32. The in-sink dishwasher according to claim 31 wherein the handle is eccentrically mounted to the shaft.

33. The in-sink dishwasher according to claim 32 wherein the handle comprises a knob and a stop extending downwardly from the knob, the knob is sized such that a portion of the knob always overlies the path of the stop as the strike is moved between the latched and released positions.

34. The in-sink dishwasher according to claim 28 and further comprising a lid-biasing device that automatically raises the lid from the closed position to at least a partially open position when the catch is disengaged from the strike face.

35. The in-sink dishwasher according to claim 34 wherein the lid-biasing device comprises a plunger reciprocally mounted to the sink such that the plunger abuts the strike face when the lid is closed and a spring biasing the plunger toward the strike face to bias the strike face away from the sink.

* * * * *